US006650176B1

(12) United States Patent
Lorenz

(10) Patent No.: US 6,650,176 B1
(45) Date of Patent: Nov. 18, 2003

(54) N-WELL RESISTOR LEAKAGE CANCELLATION

(75) Inventor: Perry S. Lorenz, Fort Collins, CO (US)

(73) Assignee: National Semiconductor Corporation, Santa Clara, CA (US)

( * ) Notice: Subject to any disclaimer, the term of this patent is extended or adjusted under 35 U.S.C. 154(b) by 0 days.

(21) Appl. No.: 10/157,638

(22) Filed: May 28, 2002

(51) Int. Cl.[7] ..... G05F 1/10
(52) U.S. Cl. ..... 327/544
(58) Field of Search ..... 327/534, 535, 327/538, 543, 544

(56) References Cited

U.S. PATENT DOCUMENTS 6,043,687 A * 3/2000 Callahan, Jr. ..... 327/73
6,150,871 A * 11/2000 Yee ..... 327/538

* cited by examiner

*Primary Examiner*—Jeffrey Zweizig
(74) *Attorney, Agent, or Firm*—Mark R. Hennings; Merchant & Gould P.C.

(57) ABSTRACT

A circuit is used to cancel the effects of leakage in resistive circuits. A resistive circuit is used to generate a reference signal. The resistive circuit is subject to leakage at high temperatures. A matching leakage generator is selected to have leakage characteristics that are similar to the leakage characteristics of the resistive circuit. The matching leakage generator is used to generate a representative leakage current that is similar to the leakage current that is undesirably present in the resistive circuit. The representative leakage current is mirrored by a current mirror circuit. The mirrored leakage current is used to cancel the effects of leakage in the resistive circuit. Canceling the leakage current improves the accuracy of the reference signal at higher temperatures. The reference signal accuracy at high temperatures is improved because the effects of leakage current (which are greater at higher temperatures) are cancelled by the mirrored leakage current.

20 Claims, 3 Drawing Sheets

N-WELL RESISTOR LEAKAGE CANCELLATION

FIELD OF THE INVENTION

The present invention relates generally to canceling high temperature leakage in resistors.

BACKGROUND OF THE INVENTION

Modern electronic circuits, such as bandgap circuits and bias circuits, typically use resistors. Low-current circuits often require large-value resistors to provide low-level currents. Large-value resistors typically have correspondingly large areas, and also have high resistivities-per-square area. N-well-type resistors are a typical example of large-value resistors.

N-well resistors have undesirable leakage at high temperatures. The leakage is the result of the resistor body forming a back-biased junction with the surrounding well or substrate. At high temperatures, current leaks from the body of the resistor to the surrounding well or substrate. The body leakage becomes significant in typical applications as temperatures increase above 100 degrees Celsius. The leakage increases exponentially with temperature and is also proportional to the resistor die-area.

Low-current circuits, using large-value resistors and small bias currents, are particularly sensitive to high-temperature leakage. High-temperature leakage usually disrupts the desired operation of low-current circuits. Accordingly, the operation of low-current circuits at high temperatures is restricted such that many low-current circuits are limited to operation at temperatures of 120 degrees Celsius or lower.

Alternatively, resistors may be reduced in size, which reduces their leakage. However, reducing the size of the resistors requires larger bias currents in order to make the leakage in the reduced size resistors less significant. The disadvantage of using larger bias currents is that larger supply currents are required, which results in higher power consumption.

High-resistance poly resistors do not have significant leakage. High-resistance poly resistors can be used as an alternative to N-well resistors. However, high-resistance poly resistors may be sensitive to changes in value due to stress on the die that occurs during packaging. The changes in the resistor values limits the applications high-resistance poly resistors.

SUMMARY OF THE INVENTION

The present invention is directed to a circuit for canceling the effects of leakage in resistive circuits. A resistive circuit is used to generate a reference signal. The resistive circuit is subject to leakage at high temperatures. A matching leakage generator is selected to have leakage characteristics that are similar to the leakage characteristics of the resistive circuit. The matching leakage generator is used to generate a representative leakage current that is similar to the leakage current that is undesirably present in the resistive circuit. The representative leakage current is mirrored by a current mirror circuit. The mirrored leakage current is used to cancel the effects of leakage in the resistive circuit. Canceling the leakage current improves the accuracy of the reference signal at higher temperatures. The reference signal accuracy at higher temperatures is improved because the effects of leakage current (which are greater at higher temperatures) are cancelled by the mirrored leakage current.

A more complete appreciation of the present invention and its improvements can be obtained by reference to the accompanying drawings, which are briefly summarized below, to the following detailed description of illustrated embodiments of the invention, and to the appended claims.

DETAILED DESCRIPTION OF THE PREFERRED EMBODIMENT

Figure 1:
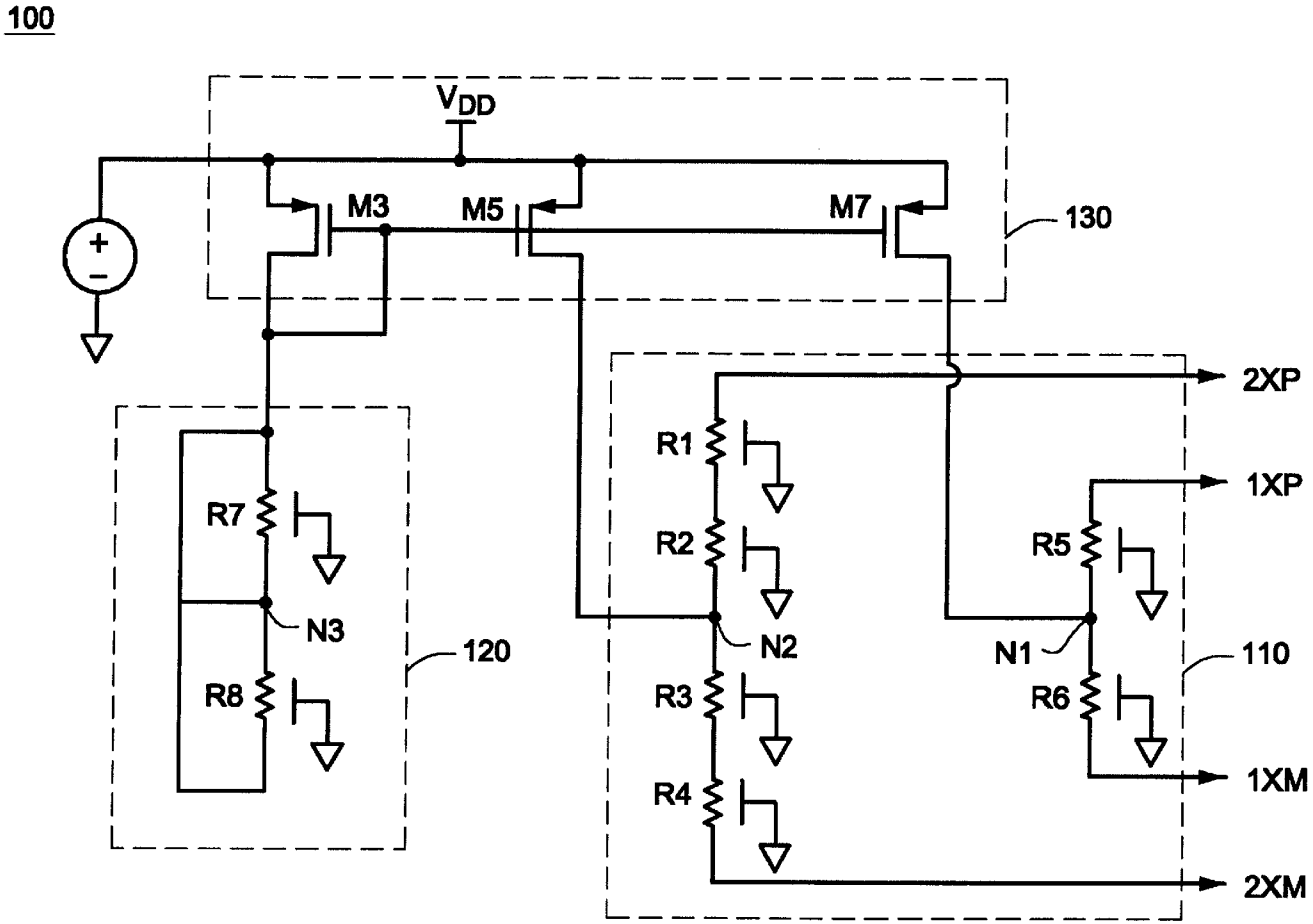
FIG. 1 is a schematic of an example circuit for canceling the effects of leakage in resistive circuits in accordance with the present invention.

In the following detailed description of exemplary embodiments of the invention, reference is made to the accompanied drawings, which form a part hereof, and which is shown by way of illustration, specific exemplary embodiments of which the invention may be practiced. These embodiments are described in sufficient detail to enable those skilled in the art to practice the invention, and it is to be understood that other embodiments may be utilized, and other changes may be made, without departing from the spirit or scope of the present invention. The following detailed description is, therefore, not to be taken in a limiting sense, and the scope of the present invention is defined only by the appended claims.

Throughout the specification and claims, the following terms take the meanings explicitly associated herein, unless the context clearly dictates otherwise. The meaning of "a," "an," and "the" includes plural reference, the meaning of "in" includes "in" and "on." The term "connected" means a direct electrical connection between the items connected, without any intermediate devices. The term "coupled" means either a direct electrical connection between the items connected, or an indirect connection through one or more passive or active intermediary devices. The term "circuit" means either a single component or a multiplicity of components, either active and/or passive, that are coupled together to provide a desired function. The term "signal" means at least one current, voltage, or data signal. Referring to the drawings, like numbers indicate like parts throughout the views.

Low-leakage resistors are desired for designing high-accuracy circuits. Polysilicon resistors, for example, can be selected that are not subject to undesirable leakage. However, packaging stress upon devices that have polysilicon resistors can cause undesirable changes in the resistivity of the polysilicon resistors. The changes in the resistivity can decrease the accuracy of the reference current.

The present invention is directed to a circuit that cancels the effects of leakage in resistive circuits. As discussed below with reference to FIG. 1, a resistor is used in a resistive circuit. A matching leakage generator is chosen to have leakage characteristics that are similar to the leakage characteristics of the resistive circuit. The matching leakage generator is used to generate a representative leakage current that is similar to the leakage current that is undesirably present in the resistive circuit. The representative leakage current is mirrored by a current mirror circuit. The mirrored leakage current is used to cancel the effects of leakage in the resistive circuit. Canceling the leakage current improves the circuit performance at high temperatures.

FIG. 1 is a schematic of an example circuit for canceling the effects of leakage in resistive circuits in accordance with the present invention. As shown in the figure, circuit 100 includes resistive circuit 110, matching leakage generator 120, and current mirror circuit 130. Resistive circuit 110 includes resistors R1–R6. Matching leakage generator 120 includes resistors R7 and R8. Resistors R1–R8 include a resistive material that is subject to leakage at high temperatures (i.e., temperatures above 100 degrees Celsius). Current mirror circuit 130 includes transistors M3, MS, and M7.

The first terminal of resistor R1 is coupled to node 2×P. The second terminal of resistor R1 is coupled to the first terminal of resistor R2. The second terminal of resistor R2 is coupled to node N2. The first terminal of resistor R3 is coupled to node N2. The second terminal of resistor R3 is coupled to the first terminal of resistor R4. The second terminal of resistor R4 is coupled to node 2×M. The first terminal of resistor R5 is coupled to node 1×P. The second terminal of resistor R5 is coupled to node N1. The first terminal of resistor R6 is coupled to node N1. The second terminal of resistor R6 is coupled to node 1×M.

The first terminal of resistor R7 is coupled to node N3. The second terminal of resistor R7 is also coupled to node N3. The first terminal of resistor R8 is coupled to node N3. The second terminal of resistor R8 is also coupled to node N3.

The source of transistor M3 is coupled to VDD. The gate and drain of transistor M3 is coupled to node N3. The gate of transistor M5 is coupled to node N3. The source of transistor M5 is coupled to VDD. The drain of transistor M5 is coupled to node N2. The source of transistor M7 is coupled to VDD. The gate of transistor M7 is coupled to node N3. The drain of transistor M7 is coupled to node N1.

Circuit 100 includes resistors R1 through R8. In an example circuit 100, the resistors are N-well resistors in a P-type substrate. The N-well resistors are formed out of an N-well material. The N-well material is an N-material containing a low amount of dopant such that a resistive path exists when the material is formed in an N-well. The P-type substrate and the N-well material form a back-biased diode through which undesirable leakage may occur.

Preferably, each of the resistors (R1 through R8) has leakage characteristics that are similar to the leakage characteristics of one another. In the example circuit, each resistor is a "unit resistor" that has the same dimensions and value. The unit resistors all have the same amount of leakage (including sidewall leakage), when the temperature is sufficiently high such that leakage occurs. Leakage may also by a function of the voltage that is applied to the resistor.

Resistive circuit 110 may be used by precision circuits that require accurate resistors. Resistors R1–R4 are biased at nodes 2×P and 2×M by a precision circuit (not shown). Resistors R5 and R6 are biased at nodes 1×P and 1×M by the precision circuit. Resistors R5 and R6 form a path that is used for a bias current that is, for example, equal to a unit current ("1×current"). Resistors R1 through R4 form a path that is used for a bias current that is, for example, scaled to twice the unit current ("2×current").

At low temperatures, resistors R7 and R8 produce no leakage. At high temperatures, resistors R7 and R8 leak current to the substrate. The leakage current is representative of another leakage current generated by resistors R5 and R6 because the resistors have similar leakage characteristics. The leakage current is also representative of leakage currents generated by resistors R1 through R4, except that resistors R1 through R4 generate twice the amount of leakage current generated by resistors R7 and R8.

The representative leakage current generated by resistors R7 and R8 is sourced from current mirror circuit 130. Transistor M3 is arranged to reflect the representative leakage current generated by resistors R7 and R8. Transistor M5, as well as transistor M7, mirrors the current flowing through transistor M3. Transistor M5 is configured to scale the current, for example to be twice the representative current. Transistor M7 is configured, for example, to produce the same representative current that flows through transistor M3.

The 1×mirror current that is provided by transistor M7 is applied between resistor R5 and resistor R6. The applied mirror current cancels the leakage to the substrate that occurs in resistor R5 and R6. The applied mirror current raises the voltage at node N1. The raised voltage gradually drops along the length of resistors R5 and R6 due to the leakage current The resulting voltages at 1×F and 1×M are equal to the voltage that would be present (if there were no leakage and no cancellation) such that leakage effects are counteracted. Because of the laws of superposition, this result is not changed by the presence of any bias current in the resistors.

The scaled 2×mirror current that is provided by transistor M5 is applied between resistors R2 and R3. The applied mirror current cancels the leakage to the substrate that occurs in resistors R1 through R4. The applied mirror current raises the voltage at node N2. The rise in voltage at node N2 is four times the rise in voltage node N1. The resulting voltages at 2×P and 2×M are equal to the voltage that would be present if there were no leakage and no cancellation. The resulting voltage is equal because the voltage drop is applied across two resistors (R2 and R1) and across two additional resistors (R3 and R4).

Figure 2:
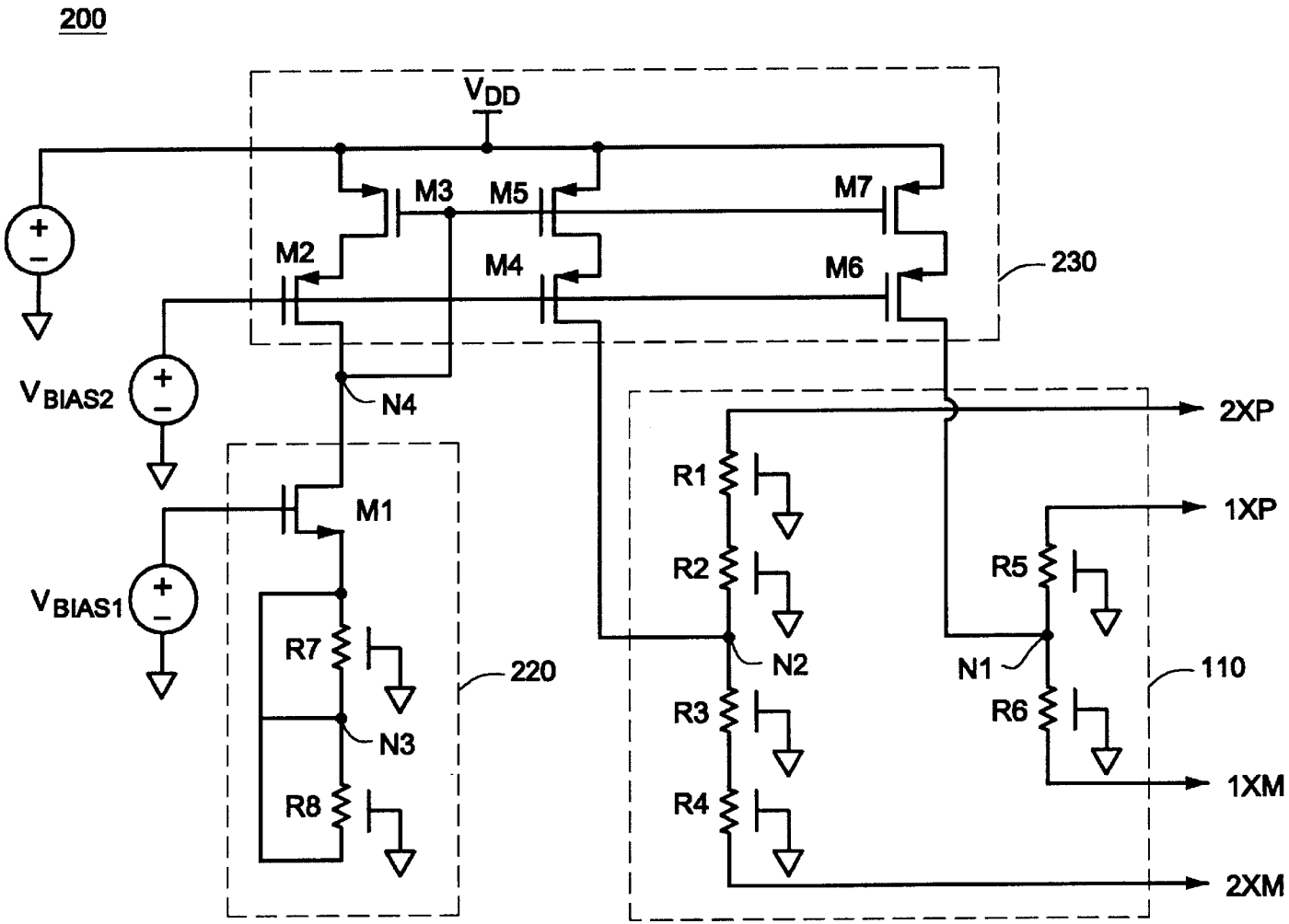
FIG. 2 is a schematic of an example circuit that includes optional cascoding in the current mirror and biasing of the resistors in the matching leakage generator in accordance with the present invention.

FIG. 2 is a schematic of an example circuit that includes optional cascoding in the current mirror and biasing of the resistors in the matching leakage generator in accordance with the present invention. As shown in the figure, circuit 200 includes resistive circuit 110, matching leakage generator 220, and current mirror circuit 230. Resistive circuit 110 includes resistors R1–R6. Matching leakage generator 220 includes transistor M1 and resistors R7 and R8. Current mirror circuit 230 includes transistor is M2–M7.

The first terminal of resistor R1 is coupled to node 2×P. The second terminal of resistor R1 is coupled to the first terminal of resistor R2. The second terminal of resistor R2 is coupled to node N2. The first terminal of resistor R3 is coupled to node N2. The second terminal of resistor R3 is coupled to the first terminal of resistor R4. The second terminal of resistor R4 is coupled to node 2×M. The first terminal of resistor R5 is coupled to node 1×P. The second terminal of resistor R5 is coupled to node N1. The first terminal of resistor R6 is coupled to node N1. The second terminal of resistor R6 is coupled to node 1×M.

The first terminal of resistor R7 is coupled to node N3. The second terminal of resistor R7 is also coupled to node N3. The first terminal of resistor R8 is coupled to node N3. The second terminal of resistor R8 is also coupled to node N3. The source of transistor MI is coupled to node N3. The gate of transistor M1 is coupled to VBIAS. The drain of transistor MI is coupled to node N4.

The drain of transistor M2 is coupled to node N4. The gate of transistor M2 is coupled to VBIAS2. The source of transistor M2 is coupled to the drain of transistor M3. The source of transistor M3 is coupled to VDD. The gate of transistor M3 is coupled to node N4. The gate of transistor M5 is coupled to node N4. The source of transistor M5 is coupled to VDD. The drain of transistor M5 is coupled to the source of transistor M4. The gate of transistor M4 is coupled to VBIAS2. The drain of transistor M4 is coupled to node N2. The source of transistor M7 is coupled to VDD. The gate of transistor M7 is coupled to node N4. The drain of transistor M7 is coupled to the source of transistor M6. The gate of transistor M6 is coupled to VBIAS2. The drain of transistor M6 is coupled to node N1.

Differences in the N-well to substrate voltages often result in resistor leakage currents not being as closely matched by leakage generator 120. Transistor M1 provides a bias voltage to reduce any small differences between the leakage of the matching leakage generator and the leakage of the resistive circuit. Power supply sensitivity is minimized as well when the resistive circuits are biased independently of the power supply.

Circuit 200 has a matching leakage generator 220 that may be biased by voltage reference signal VBIAS1. The level of voltage reference signal VBIAS1 is selected such that transistor M1 biases resistors R7 and R8. Resistors R7 and R8 are biased to a voltage potential that approximates the expected voltage potential of resistors R1 through R6. Resistors R7 and R8 are biased to the same level as resistors R1 through R6 such that all of the resistors will leak in a similar fashion. Thus, biasing resistors R7 and R8 improves the degree to which the representative leakage current matches the leakage of, for example, resistors R5 and R6.

Transistors M2, M4, and M6 are cascode devices to increase the source impedance of the current mirror. Cascodes may be unnecessary in certain applications, and are thus optional components.

Figure 3:
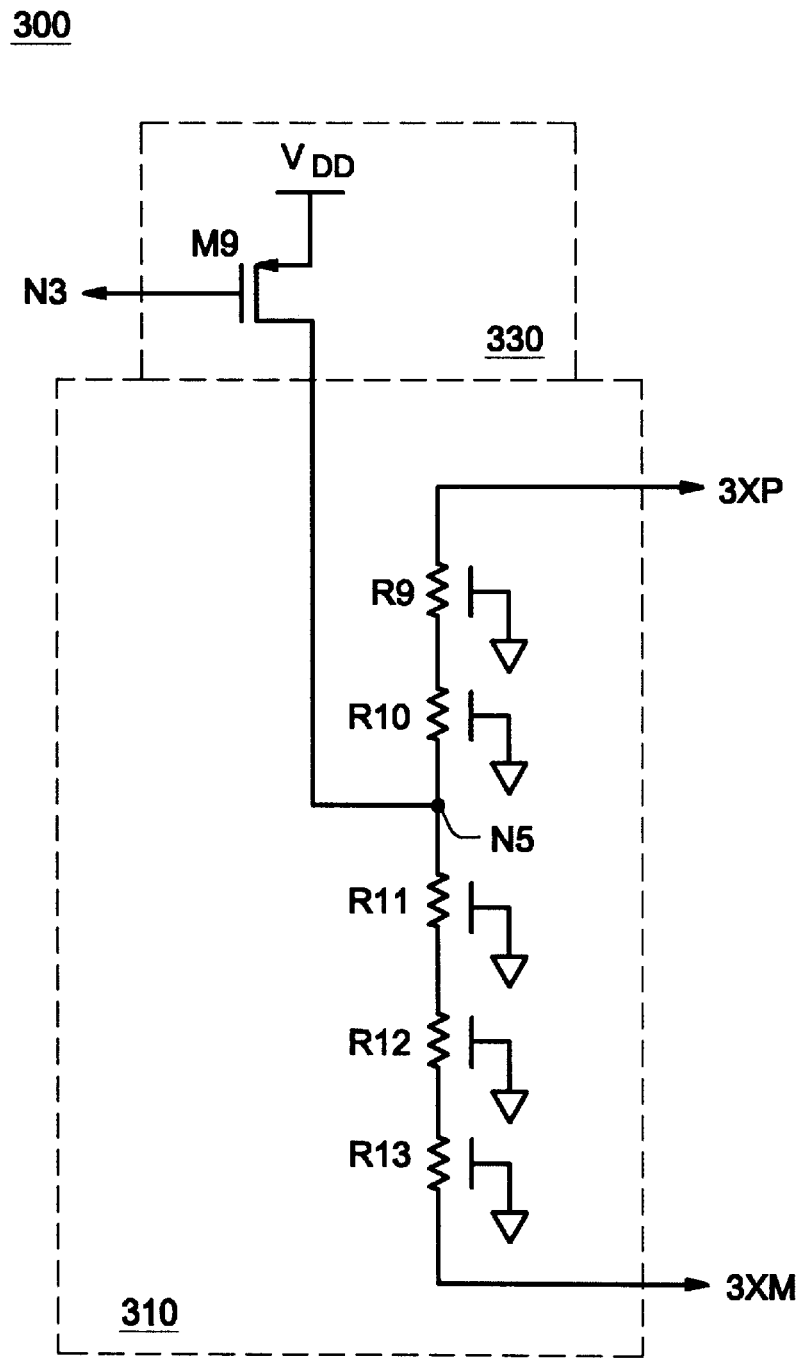
FIG. 3 is a schematic of an example circuit that includes an alternate configuration of biasing in a resistive circuit in accordance with the present invention.

FIG. 3 is a schematic of an example circuit that includes an alternate configuration of biasing in a resistive circuit in accordance with the present invention. As shown in the figure, circuit 300 includes resistive circuit 310 and current mirror circuit 330. Resistive circuit 310 includes resistors R9–R13. Current mirror circuit 230 includes transistor M9.

The source of transistor M9 is coupled to VDD. The gate of transistor M9 is coupled to node N3, which corresponds to the node N3 of FIG. 1. The drain of transistor M9 is coupled to node N5. The first terminal of resistor R9 is coupled to node 3×P. The second terminal of resistor R9 is coupled to the first terminal of resistor R10. The second terminal of resistor R10 is coupled to node N5. The first terminal of resistor R11 is coupled to node N5. The second terminal of resistor R11 is coupled to the first terminal of resistor R12. The second terminal of resistor R12 is coupled to the first terminal of resistor R13. The second terminal of resistor R13 is coupled to node 3×M.

A reflected representative leakage current (from transistor M3 and resistors R7 and R8, shown in FIG. 1) is provided at node N3. Transistor M9 mirrors the current flowing through transistor M3. Transistor M9 is configured to scale the current, for example to be a factor of 2.5 times larger than the representative current. The scaled current is applied to node N5, which is between resistors R10 and R11. The applied scaled mirror current cancels the leakage to the substrate that occurs in resistors R9 through R13. The applied mirror current raises the voltage at node N2. The raised voltage gradually drops along the lengths of in resistors R9 through R13. The resulting voltages at 3×P and 3×M are equal to the voltage that would be present (if there were no leakage and no cancellation) such that leakage effects are counteracted.

Other embodiments of the invention are possible without departing form the spirit and scope of the invention. For example, any representative resistive device having leakage can be used to generate a representative leakage current that can be mirrored. The mirrored current can be scaled and used to compensate for the effects of high temperature upon other resistive circuits that are of the same type as the representative resistive device that is used to generate the leakage current.

In another example, resistors used in resistive circuits and matching leakage generators may not require identical leakage current characteristics. The degree to which the leakage current characteristics should be matched is dependent upon a performance desired.

In similar fashion, resistors used in resistive circuits and matching leakage generators may not require identical resistive values or dimensions. The degree to which the resistor values or dimensions should be matched is dependent upon the performance desired. Indeed, the values of the resistors can be changed to accommodate design requirements for resistive circuits.

Although N-well resistors are shown in an example embodiment, P-type resistors may be used as well. P-type resistors could be used in an N-well that is biased to VDD, such that leakage occurs from VDD to the P+ resistor. NMOS transistors are used for mirror transistors when P-type resistors are used. Thus in the example circuit of FIG. 2, transistors M2 through M7 would be implemented as NMOS transistors.

The above specification, examples and data provide a complete description of the manufacture and use of the composition of the invention. Since many embodiments of the invention can be made without departing from the spirit and scope of the invention, the invention resides in the claims hereinafter appended.

I claim:

1. A circuit for canceling leakage in resistive circuits, comprising:

a first resistive circuit that is arranged to generate a first reference signal, wherein the first resistive circuit has a reference resistor;

a matching leakage generator that comprises a matching leakage resistor, wherein the matching leakage resistor is configured to have leakage characteristics that match the leakage of the reference resistor; and a current mirror that is configured to provide a current to the matching leakage resistor, reflect a first mirrored leakage current such that the first mirrored leakage current reflects the current provided to the matching leakage resistor, and provide the first mirrored leakage current such that the leakage of the reference resistor is canceled.

2. The circuit of claim 1 wherein the reference signal is proportional to temperature of the resistive circuit.

3. The circuit of claim 1 wherein the matching leakage resistor has the same physical dimensions of the reference resistor.

4. The circuit of claim 1 wherein the matching leakage generator comprises a plurality of matching leakage resistors and wherein the resistive circuit comprises a plurality of reference resistors.

5. The circuit of claim 4 wherein the mirrored leakage current is applied to a node in the resistive circuit, wherein the node is coupled between two of the plurality of reference resistors, whereby equal currents flow through two of the plurality of resistors.

6. The circuit of claim 4 wherein the mirrored leakage current is applied to a node in the resistive circuit, wherein the node is coupled between two of the plurality of reference resistors, whereby unequal currents flow through two of the plurality of resistors.

7. The circuit of claim 1 further comprising a second resistive circuit, wherein the current mirror is configured to provide a second mirrored leakage current to the second resistive circuit, wherein the second mirrored leakage current has a current level that is different from the first mirrored leakage current.

8. The circuit of claim 7 wherein the second resistive circuit produces a second reference signal that has a current level that is different from the current level of the first reference signal.

9. The circuit of claim 1 wherein the matching leakage generator further comprises a transistor for biasing the matching leakage resistor to the same voltage-to-substrate potential as the reference resistor.

10. A circuit for canceling leakage in resistive circuits, comprising:

means for generating a first reference signal, wherein the means for generating the first reference signal comprises a reference resistor;

means for generating a representative leakage current, wherein the means for generating the representative leakage current comprises a matching leakage resistor, wherein the matching leakage resistor is configured to have leakage characteristics that match the leakage of the reference resistor;

means for reflecting a first mirrored leakage current such that the first mirrored leakage current reflects the current provided to the matching leakage resistor; and means for applying the first mirrored leakage current to the reference resistor such that the leakage of the reference resistor is canceled, whereby the first reference signal is not affected by the leakage of the reference resistor.

11. The circuit of claim 10, wherein the means for generating the representative leakage current comprises a matching leakage resistor that has the same physical dimensions of the first reference resistor.

12. The circuit of claim 10, further comprising:

means for generating a first reference signal, wherein a reference resistor is used to generate the first reference signal, means for reflecting a second mirrored leakage current such that the second mirrored leakage current reflects the representative leakage current according to a scaling factor; and means for applying the second mirrored leakage current to the reference resistor such that the leakage of the reference resistor is canceled, whereby the first reference signal is not affected by the leakage of the reference resistor.

13. The circuit of claim 10, further comprising means for biasing the matching leakage resistor to the same voltage-to-substrate potential of the first reference signal.

14. The circuit of claim 10, further comprising means for cascoding a transistor that is used to provide the reflected current, whereby a source impedance of the transistor is increased.

15. A method for canceling leakage in resistive circuits, comprising:

generating a first reference signal, wherein a first reference resistor is used to generate the first reference signal;

generating a representative leakage current, wherein a matching leakage resistor is used to generate the representative leakage current, and wherein the matching leakage resistor is configured to have leakage characteristics that match the leakage of the reference resistor, reflecting a first mirrored leakage current such that the first mirrored leakage current reflects the representative leakage current; and applying the first mirrored leakage current to the reference resistor such that the leakage of the reference resistor is canceled, whereby the first reference signal is not affected by the leakage of the reference resistor.

16. The method of claim 15, wherein the first mirrored leakage current is applied such that the leakage due to temperature of the reference resistor is canceled.

17. The method of claim 15, wherein the representative leakage current is generated by a matching leakage resistor that has the same physical dimensions of the first reference resistor.

18. The method of claim 15, further comprising:

generating a first reference signal, wherein a reference resistor is used to generate the first reference signal;

reflecting a second minored leakage current such that the second mirrored leakage current reflects the representative leakage current according to a scaling factor; and applying the second mirrored leakage current to the reference resistor such that the leakage of the reference resistor is canceled, whereby the first reference signal is not affected by the leakage of the reference resistor.

19. The method of claim 15, further comprising biasing the matching leakage resistor to the same voltage-to-substrate potential of the first reference signal.

20. The method of claim 15, further comprising cascading a transistor that is used to provide the reflected current, whereby a source impedance of the transistor is increased.

* * * * *

UNITED STATES PATENT AND TRADEMARK OFFICE

CERTIFICATE OF CORRECTION

PATENT NO. : 6,650,176 B1
DATED : November 18, 2003
INVENTOR(S) : Perry S. Lorenz It is certified that error appears in the above-identified patent and that said Letters Patent is hereby corrected as shown below:

Column 3,
Line 14, change “MS” to -- M5 --.

Column 4,
Lines 63 and 65, change “MI” to -- Ml --.

Column 7,
Line 49, change “signal,” to -- signal; --.

Column 8,
Line 21, change “resistor,” to -- resistor; --.
Line 41, change “minored” to -- mirrored --.
Line 52, change “cascading” to -- cascoding --.`

Signed and Sealed this

Twenty-first Day of June, 2005

JON W. DUDAS
*Director of the United States Patent and Trademark Office*